United States Patent [19]

Leroy

[11] Patent Number: 4,692,105

[45] Date of Patent: Sep. 8, 1987

[54] ROLLER DISPLACEMENT MOTOR

[76] Inventor: André Leroy, 64 Chaussée de Binche, B 7030 Saint Symphorien, Belgium

[21] Appl. No.: 733,807

[22] Filed: May 14, 1985

[30] Foreign Application Priority Data

May 21, 1984 [FR] France ..... 84 08299

[51] Int. Cl.[4] ..... F03C 2/00; F01C 1/00; F04C 2/00

[52] U.S. Cl. ..... 418/184; 418/225

[58] Field of Search ..... 418/225–227, 418/184, 210–215

[56] References Cited

U.S. PATENT DOCUMENTS

| | | | |
|---|---|---|---|
| 856,317 | 6/1907 | Towlson | 418/225 |
| 3,402,672 | 9/1968 | Cook | 418/225 |
| 3,542,498 | 11/1970 | Sadler | 418/225 |
| 3,567,350 | 3/1971 | Niemiec | 418/225 |
| 3,588,297 | 6/1971 | Crump | 418/212 |
| 3,718,411 | 2/1973 | Pollman | 418/225 |
| 3,740,954 | 6/1973 | Young | 418/212 |
| 4,105,377 | 8/1978 | Mayall | 418/225 |

FOREIGN PATENT DOCUMENTS

| | | | |
|---|---|---|---|
| 151090 | 9/1982 | Japan | 418/212 |

*Primary Examiner*—Carlton R. Croyle
*Assistant Examiner*—Jane E. Obee
*Attorney, Agent, or Firm*—Kerkam, Stowell, Kondracki & Clarke

[57] ABSTRACT

A roller-type positive displacement fluid motor comprises a substantially circular rotor disposed within a stator ring having a generally elliptical profile, the rotor having a plurality of slots formed in its surface, each slot guiding a cylindrical roller which contacts the inner surface of the stator ring and moves radially inwardly and outwardly as the rotor rotates. Inlet ports are located in a first end plate such that they are opened and closed by the leading and trailing faces of the slots, and outlet ports are located in an end plate such that they are opened and closed by the rollers contacting the inner surface.

7 Claims, 3 Drawing Figures

ROLLER DISPLACEMENT MOTOR

BACKGROUND OF THE INVENTION

1. Field of the Invention

The invention relates to a roller positive displacement motor capable of operating with any type of fluid, either liquid or gaseous.

The motor comprises at least one motor unit having the following elements and features: a stator housing composed of a tubular body (stator ring) and two end plates.

The inner surface of the stator ring (stator surface) is a generally elliptical shaped cylindrical surface, the directrix of which is a displacement curve having a symmetry order of two with respect to its center, a shaft rotatably supported within the housing;

a rotor fixed on this shaft, the outer surface of which rotor is a cylinder having a circular directrix (rotor cross section profile). A number $n_r$ of identical axially extending slots, opened in the outer surface of the rotor, are machined at equal angular intervals about the rotor. These slots are bounded on both sides by two plane faces parallel to a median plane, either radial or not;

cylindrical rollers, the number of which is $n_r$, guided in the slots of the rotor, so as to remain in axial contact with the ring inner surface and to define in this way working chambers. Each of these working chambers has a volume defined by the stator ring surface, two consecutive rollers, and by the surface of the rotor, including a variable part of the volume of the slots wherein the rollers are moving.

One face of a slot is the leading face on which the roller is applied when it is driving the rotor, and the other face is the trailing face on which the roller is resting when it is driven by the rotor.

Inlet and outlet ports are bored in the stator housing and possibly managed with valves, to afford inlet and outlet of fluid.

A motor which, as described herein, comprises a single rotor and a single stator ring will be referred to as a motor unit. A volume comprised between the rotor, the stator ring and the two end plates will be referred to as a working chamber. As will be described, the working chamber volume varies during operation of the motor unit.

As the ratio of the length of the rollers to their diameter is of course limited to insure their convenient guiding, it is necessary to employ a multiple unit motor" if this motor must have a great displacement without having too large an external diameter and too great a sliding velocity of the rollers on the stator surface.

A motor comprising a k number of motor units uses obviously k rotors fixed on the same shaft and a stator composed of k stator rings, of (k−1) intermediate stator plates, each of these plates separating two units, and two flanges working as end plates.

2. Description of the Prior Art

Roller displacement machines, operating as liquid pumps, have been described and are produced. They have, as often as not, a liquid distribution organisation quite close to that of a vane machine, and the rollers are formed to have a necessary large clearance with respect to their guiding slot so that they come into contact with either one or the other face of the slot, enabling the roller to work as an internal distribution element, attempting to avoid a situation where some volume of the liquid can be, at one moment of its evolution, enclosed in a closed working chamber, the volume of which is reducing. Practically, this desired does not seem to be reached exactly, and temporary overpressures occur in known pumps (refer to patent GB-No. 2.028.430-A).

Experience demonstrates that this type of pump cannot be converted into a hydraulic motor. When inlet and outlet ports are reciprocally exchanged, the torque supplied by the shaft of the machine varies quite irregularly with the rotation angle of the shaft, and even, for some of the machines, reverses periodically.

Design requirements thus seem to be much more strict for a roller motor than for the corresponding pump, especially if the fluid with which the machine exchanges energy is a liquid. A pump is usable even when the torque applied to the shaft is strongly variable, whereas a motor is not suitable in the same conditions.

This is probably the reason why roller motors have been used and industrially produced infrequently. The only patent we know as related to such a motor in the U.S. Pat. No. 2,826,179 (KLESSIG). In the hydraulic motor disclosed by KLESSIG, the distribution of fluid is quite close to that of a vane machine. Furthermore, KLESSIG recites that the "driving elements" of his motor may be either rollers or vanes.

SUMMARY OF THE INVENTION

All the new features of our roller motor are to insure a great regularity of the delivered torque.

Some of these features are peculiar to each unit, whatever their number. With a view to making these features clear, they will be described referring to a single-unit motor.

Other original features belong to multiple-unit motors and will be described afterwards.

The advantages afforded by our motor are based on the four following features, which are to be simultaneously realized in order to insure a satisfactory regularity of the delivered torque, especially when the fluid from which the motor receives energy is a liquid:

(1)-the stator ring inner surface has symmetry order of two with respect to its axis, which is identical to the common rotation axis of the rotor and the shaft. In order words, the displacement curve has symmetry order of two with respect to its center, which is identical to that of the rotor profile, (2)-the number of slots machined in the rotor, and thus the number of rollers, is an odd number $n_r$* in the single-unit motor, (3)-each roller has in new condition with respect to its guiding slot faces a clearance as small as possible to allow its radial motion, (4)-the fluid is distributed through ports which are successively closed and opened by the rotor and the rollers according to the invention, as described hereafter.

Two inlet ports are bored in one end plate and two outlet ports in the other end plate, or two inlet ports are symmetrically located in both flanges and two outlet ports as symmetrically located in the stator ring, so as to equalize the axial forces applied by the working fluid to the rotor.

These inlet and outlet ports are located at different radii with respect to the geometrical locus of points defined by the contact between a roller and its leading slot face during a complete revolution of the rotor, while this roller remains in contact with the stator ring inner surface.

This geometrical locus is composed of two closed curves, very close to one another and corresponding respectively to the locus of points described by the points of contact of the roller with the leading face and with the trailing face of its slot over a complete revolution. In the motor according to the invention the inlet ports are located at a radius which is entirely inside and the outlet ports at a radius which is entirely outside of the geometrical locus formed by said two closed curves. Practically, however, this condition is automatically fulfilled when the inlet ports are located at a radius which is less than the polar radius of the closed curve defined by the points of contact of the roller with the leading fact of its slot during a revolution of the rotor, and when the outlet ports are located at a radius greater than the polar radius of said closed curve.

The fluid distribution through these ports is organised according to the three following features:

(1)-owing to its motion, the rotor closes an inlet port by means of the trailing face of a slot, and opens the following outlet port by means of the roller guided in the same slot. This feature of the fluid distribution makes the fluid parting and directing organisation quite different from that of a vane motor, in which the rotor, owing to this motion, closes an inlet port by means of a vane and opens the following outlet port by means of the preceding vane delimiting the same working chamber, (2)-the outlet ports are angularly located in the housing so that the opening of an outlet port happens close to the position of the operating roller in which it reaches its maximum outward stroke and begins its inward stroke (thus close to the position corresponding to the maximum radial displacement of the roller with respect to the axis of the rotor), and, in preference, exactly in this position. Moreover, in a motor receiving energy from a liquid, the inlet ports are angularly located so that the closure of an inlet port by means of the trailing face of the slot happens ideally at the same time as the opening of the outlet port by means of the roller guided in the same slot. In a motor receiving energy from a gas, the inlet ports may be angularly located so that the closure of an inlet port by means of the trailing face of a slot happens before the opening of the outlet port by means of the roller guided in the same slot, so as to allow some expansion of the gas in the motor.

(3)-the opening of each inlet port is realized by the leading face of a slot, and because of the location of each inlet port at a radius which is less than the aforesaid geometrical locus, the pressurized fluid is of course supplied between the bottom of the slot and the point of contact between the roller on and face of its slot, provided that this roller is in contact with the stator surface. Just before the opening of an inlet port, the roller is driven by the rotor, and it tends to rest on the trailing face of its slot. The trailing face of the slot is formed to allow the pressurized fluid to flow towards the expanding working chamber. According to the invention, this is accomplished by machining an open channel in the trailing face of the slot, the cross section of which is large enough to offer to the flow of the pressurized fluid a resistance smaller than the resistance it would encounter by flowing between the roller and the leading face of the slot, towards the outlet port just opened the clearance between the roller and the slot face increases. The roller is working loose in the slot.

The shape of the stator ring displacement curve, i.e., its cross sectional profile, has practically little effect on the behaviour of a motor according to the invention, provided that this profile is a continuous curve. Most profile curves having an elliptical shape, as used in vane machines, yield results quite close to one another and can thus be transposed to the invention.

When the fluid from which the motor receives energy is liquid, a sealing zone between the rotor cross sectional profile and the stator ring cross sectional, in which the two curves are parallel to one another with a clearance as small as possible, is not absolutely necessary. A satisfactory displacement curve can than be obtained by using the "Polygon P2 profile", well known to European machine designers. The corresponding stator ring inner surface can be mechanically generated on available special grinding machines.

The only two parameters which are to be set to generate such a stator surface are the mean radius and the excentricity of the profile. The Polygon profile as used as a displacement curve in a motor according to the invention has a mean radius equal to the rotor radius increased by half the maximum radial stroke of the rollers, and has an excentricity equal to half this maximum stroke.

In a motor comprising a single motor unit according to the invention, any odd number of rollers may be used. Experimental results show an optimum number of rollers to be equal to seven.

Notable wear of the rollers can of course hurtly affect the behaviour of the motor, and care should be given to the selection of materials which minimize wear. In the motor according to the invention however, rollers revolve by themselves while they are driven by the rotor. This motion automatically distributes wear on the whole periphery of the rollers. In a multiple unit motor, the regularity of the supplied torque can be increased if the working chambers are, in each unit, angularly shifted with respect to one another so that the working chambers are out of phase. If all units are identical, the best result in this way will be reached when the working chambers have a phase displacement $\delta^*$ equal to $\pi/kn_r^*$.

This result can be obtained by fixing the rotors on the shaft with this relative angular shift with respect to one another without shifting the stator rings, or by locating the stator rings with respect to one another with this relative angular shift without shifting the rotors, or by combining an angular shifting of both the rotors and the stator rings.

It should be observed that, if the number of motor units forming a motor is an even number, and if the ports of each type (inlet or outlet ports) are alternately located angularly in one end plate, the axial fluid thrusts on the rotors balanced in the aggregate so that the bearings of the several unit motor are free of any axial thrust due to the fluid.

The regularity of the torque supplied by a multiple unit motors does not necessarily need the greatest regularity of the torque supplied by each unit. In a multiple unit motor, each motor unit according to the invention may have an even $n_r^{}$ number of rollers, provided that the working chambers vary out of phase between the different units. Under these conditions, the greatest regularity of the supplied torque is obtained when the working chambers vary, in each unit with respect to the following one starting from one end-plate of the motor, with a phase displacement $\delta^{}$ equal to $2\pi/kn_r^{**}$.

In a multiple unit motor according to the invention, in each unit of which the rollers are an even $n_r$** number, the radial thrusts balance on each rotor, so that the bearings of this motor are free of any radial load due to the fluid. Combining different afore-mentioned features, multiple unit motors according to the invention can thus be designed so the bearings are free of any load -either axial or radial-due to the fluid.

Experience demonstrates that, though they have been conceived primarily as motors, roller displacement machines according to the invention in which the inlet ports close at the same time as the outlet ports open, may reciprocally work as pumps whatever the pumped fluid may be, when they are driven in the opposite direction, inlet and outlet ports being obviously exchanged. Such pumps avoid the aforementiond overpressures, even if the pumped fluid is a liquid, but they require in practice a reverse flow valve in connection with each outlet port.

In the same way, gas motors according to the invention, in which the inlet ports close some time before the outlet ports open, can be reciprocally used as compressors.

The main interest of the motors according to the invention, with respect to the comparable displacement motors, lies in the obvious simplicity of their constituting parts. Most of them could be manufactured using powder metallurgy, to reduce subsequent machinings.

In this way, it is as a rule possible, for difficult applications, to form out of ceramic materials, parts of the motor which are subject to abrasive wear.

BRIEF DESCRIPTION OF THE DRAWINGS

FIG. 1 is a cross section view perpendicular to the common rotation axis of the shaft and of the rotor. In this figure, point 0 is a center of symmetry for the drawn section.

FIG. 2 is an axial split cross section view of the motor taken along lines OA and OB on FIG. 1.

DESCRIPTION OF THE PREFERRED EMBODIMENT

Figure 1:
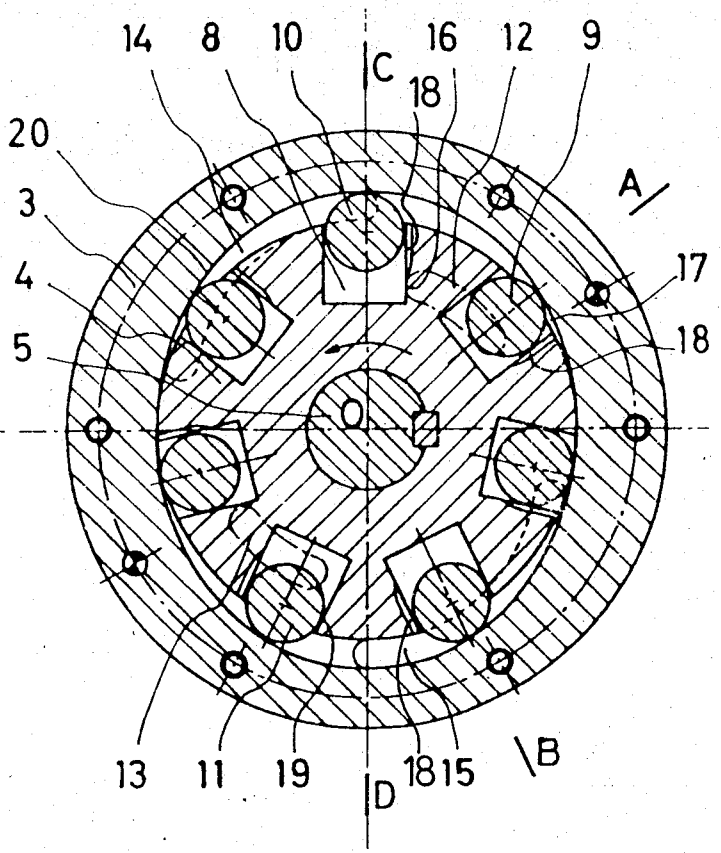
FIG. 1 and FIG. 2 illustrate a motor unit according to the invention.
Figure 2:
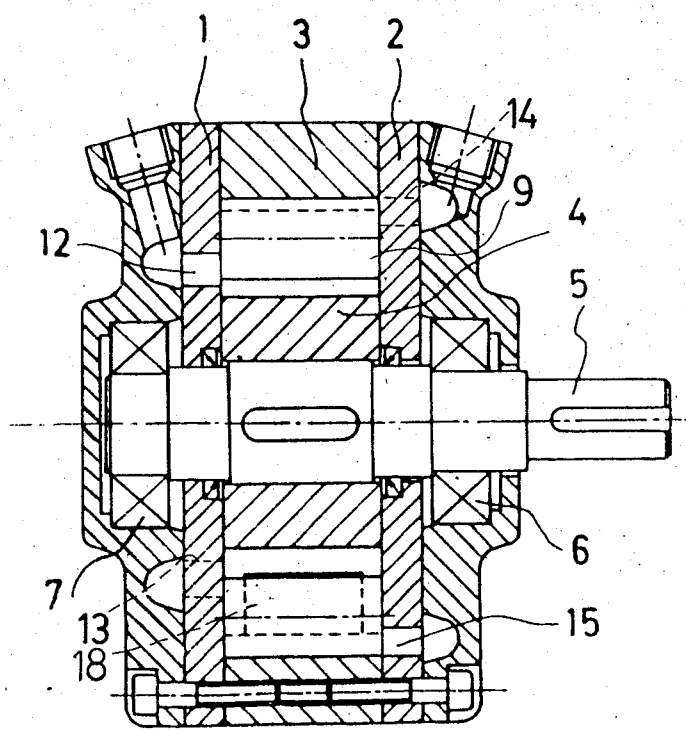

FIGS. 1 and 2 illustrate a motor unit in accordance with the invention. As shown, the motor unit has a housing formed by two end plates 1, 2, disposed at opposite ends of a tubular stator ring 3. A shaft 5 is rotatably supported within the housing by roller bearings 6 and 7 for rotation about an axis 0. The rotor revolves in the direction of the arrow shown in FIG. 1 (counterclockwise in the figure).

As shown in FIG. 1, rotor 4 has a substantially circular cross sectional profile, while the inner surface of the stator ring has an elongated generally elliptical profile 20, which may be a Polygon P2 profile as previously described. The minor axis of the stator ring inner surface (the horizontal axis in FIG. 1) is substantially equal to the diameter of the rotor, while the major axis of the inner surface profile (the vertical axis along line CD in FIG. 1) is greater than the diameter of the rotor, as shown, so that two crescent-shaped spaces are formed between the stator ring inner surface and the surface of the rotor, at the top and bottom of the rotor as shown.

The surface of the rotor has formed therein a plurality of slots, such as shown at 8, which are equi-angularly spaced about the rotor. Preferably, the number of slots is an odd number and equal to seven as shown. Disposed within each slot is a corresponding roller, such as 9, 10 and 11, and the slots serve to guide the rollers. Each slot has a leading face, such as 19, referenced with respect to the direction of rotation of the rotor, and a trailing face, such as 16, and the rollers are sized to have a diameter so as to afford a minimum clearance between the slot faces and the rollers and such that the rollers may freely move radially within the slots. Each trailing face of a slot has an open channel 18 which connects the surface of the rotor to the portion of the slot beneath the roller.

A pair of fluid inlet ports 12 and 13 may be located in end plate 1, and a pair of fluid outlet ports 14 and 15 may be located in the other end plate 2. To facilitate an understanding of the invention, inlet ports 12 and 13 are shown in dotted lines in FIG. 1 along with outlet ports 14 and 15. As shown, the inlet ports are disposed symmetrically in the end plate with respect to axis 0 such that they are diametrically opposed, and the outlet ports 14 and 15 are disposed symmetrically in the end plate with respect to axis 0 such that they are diametrically opposed and located angularly between the inlet ports. As shown in FIG. 1, both the inlet and outlet ports comprise angularly extending accuate slots, and the inlet ports are located at a smaller radius from the axis than the outlet ports.

As the rotor rotates within the stator ring, the rollers contact the inner surface of the stator ring and move radially inwardly and outwardly within their slots in accordance with the profile of the stator ring inner surface. In the position of the rotor shown in FIG. 1, roller 10 has reached its maximum radial extent and is ready to begin an inward movement (stroke) upon further rotation of the rotor. Roller 10 is also ready to open outlet port 14 to the space between rollers 9 and 10 defined by the rollers, the inner surface of the stator ring, and the outer surface of the rotor. The trailing face 16 of slot 8 is simultaneously ready to close inlet port 12 to the portion of slot 8 beneath roller 10. On the other hand, as shown in the figure, inlet port 12 is open to the portion of the slot beneath roller 9 and admits fluid into this space. This fluid flows via open channel 18 in the trailing face of that slot to the space 17 defined between the roller, the inner surface of the stator ring, and the outer surface of the rotor. Space 17 comprises a working chamber, the volume of which expands upon rotation of the rotor. As the fluid flows into the expanding working chamber 17, it exerts a pressure on roller 9, forcing the roller against the leading edge of its slot so that the roller becomes a driving roller for the rotor. At the position of the rotor illustrated in FIG. 1, roller 11 is serving as a driving roller, being pushed against the leading face 19 of its slot, by virtue of fluid entering inlet port 13 and being communicated via the open channel to the expanding working chamber formed between rotor 11, the inner surface of the stator ring, the outer surface of the rotor, and the adjacent trailing roller (unnumbered in the figure). The remaining rollers are being drivin by the rotor and are urged against the trailing faces of their corresponding slots. Upon outlet port 14 being opened by roller 10, the fluid contained in the space defined between rollers 9 and 10 and the surfaces of the stator ring and rotor is exhausted through the outlet port.

From the foregoing, it can be seem that the opening and closing of the outlet ports is accomplished by the rollers, whereas the opening and closing of the inlet ports is accomplished by the leading and trailing faces, respectively, of the slots. In order to accomplish this, the inlet ports must be located at an appropriate radial distance from the axis to enable them to be uncovered and covered by the leading and trailing edges of the slots, and the outlet ports must be located at a greater radial distance from the axis so that they are open and closed by the roller contacting the inner surface of the stator ring. Stated another way, as the rotor executes one complete revolution, the points of contact between the roller and the leading and trailing faces of its slot trace first and second imaginary curves which are very close together. The inlet ports must be located at a radius which is within the geometrical locus of points which constitute the imaginary closed curve defined by the contact between the roller and the leading face of its slot over a complete revolution, i.e., less than the radial distance between the axis and the imaginary curve, whereas the outlet ports must be located outside of this locus of points, i.e., at a greater radial distance than this curve. The reason for this is that for the inlet ports to be opened by the leading and trailing faces of the slot, they must be located at a radius which is less than the points of contact between the roller and the leading face. Otherwise, the rollers would not serve to seal the inlet ports from the working chambers. Similarly, the outlet ports must be at a radius greater than the points of contact between the rollers and the leading face so that the rollers seal the outlet ports from the space beneath the rollers. This is best shown by reference to FIG. 1 where it can be seen that the points of contact between roller 9 and its leading face is located at a greater radius than inlet port 12, and where the points of contact between roller 10 and the leading face of its slot 8 are at a radius which is less than the radius of outlet port 14.

Figure 3:
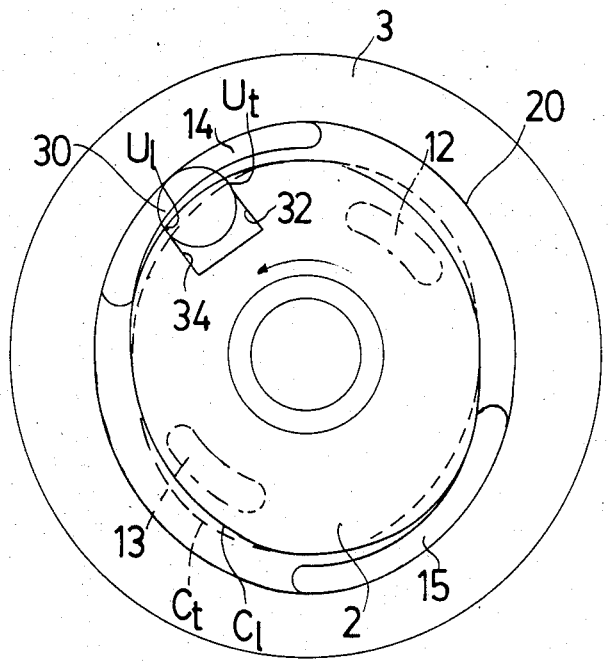
FIG. 3 is a diagrammaic view illustrating the location of the inlet and outlet ports with respect to imaginary curves defined by the geometrical locus of points of contact between a roller and the leading and trailing faces of a slot over one revolution of the rotor with the roller in contact with the inner surface of the stator of the motor unit.

FIG. 3 illustrates diagrammatically the locations of a pair of inlet ports 12 and 13 and a pair of outlet ports 14 and 15 in an end plate 2 of the stator housing relative to first and second imaginary curves $C_t$ (in dotted lines) and $C_1$ (in solid lines) described by the geometrical locus of points defined by the point of contact $U_t$ of a roller 30 with a trailing face 32 of its slot and the point of contact $U_1$ of the roller with the leading face 34 of its slot over one complete revolution of the rotor with the roller 30 in contact with the inner surface 20 of the stator ring. As shown, the inlet ports 12 and 13 are entirely located at a radius which is less than the radius of the imaginary curve $C_1$ and the outlet ports 14 and 15 are entirely located at a radius greater than this curve.

I claim:

1. A roller-type positive displacement fluid machine including at least a motor unit capable of working reciprocally as a pump and a compressor, the motor unit comprising a housing formed by a cylindrical stator ring and first and second end plates, the stator ring having a cylindrical inner surface with a generally elliptical profile, a shaft rotatably supported within the housing for rotation about an axis, a cylindrical rotor fixed on the shaft within the housing, the rotor having a circular rotor profile and a plurality of slots disposed at equal angular intervals about the surface of the rotor, each slot being defined by a substantially planar leading face and a substantially planar trailing face, a cylindrical roller disposed in each slot, the rollers being sized to have a minimum clearance with respect to the slots so that they freely move radially within the slot for contact with the inner surface of the stator ring, the points of contact between the roller and the leading face over one complete revolution of the rotor describing a geometrical locus of points which define an imaginary closed curve, and the space defined by two consecutive rollers, the rotor surface, and the inner surface of the stator ring constituting a working fluid chamber, the trailing face of each slot having an open channel therein connecting the portion of the slot beneath the roller with the surface of the rotor and the working chamber, and fluid inlet ports and outlet ports disposed within said housing, the inlet ports being entirely located at a radius less than the radius of said imaginary curve formed by said geometrical locus of points and such that the inlet ports may be opened and closed by the leading and trailing faces, respectively, of said slots, and said outlet ports being entirely located at a radius greater than the radius of said imaginary curve formed by said geometrical locus of points and such that the outlet ports are opened and closed by said rollers contacting the inner surface of the stator ring, and wherein the outlet ports are angularly located such that they are opened at substantially the position of a roller at which the roller has reached its maximum radial stroke and will start an inward stroke, and the inlet ports being angularly located such that they are closed by the trailing face of each slot.

2. A roller displacement machine according to claim 1, wherein the inlet ports are located in one end plate and the outlet ports are located in the other end plate.

3. A roller displacement machine according to claim 1, wherein the inlet ports are located symmetrically in both end plates.

4. A roller displacement machine according to claim 1, wherein each outlet port is angularly located so as to be opened exactly in the position of the roller in which this roller reaches its maximum stroke.

5. A roller displacement machine according to claim 1, wherein said fluid is a gas and each inlet port has such an angular extent in a direction of rotation of the rotor that the closure of the inlet port, by means of the trailing face of a slot, happens before the opening of the outlet port by means of the roller guided in the same slot, so as to allow some expansion of the gas inside of the working chamber.

6. A roller displacement machine according to claim 1, comprising a single motor unit wherein the number of rollers is odd.

7. A roller displacement machine according to claim 1, wherein said fluid is a liquid and each inlet port has such an angular extent in a direction of rotation of the rotor that the closure of an inlet port, by means of the trailing face of a slot, happens simultaneously with the opening of an outlet port by means of the roller guided in the same slot.

* * * * *